United States Patent [19]

Maki

[11] 4,452,144

[45] Jun. 5, 1984

[54] SHOTGUN CARTRIDGE AND WAD THEREOF

[76] Inventor: Nagatoshi Maki, 2-48-4, Kamiishihara, Chofu-shi, Tokyo, Japan

[21] Appl. No.: 280,788

[22] Filed: Jul. 6, 1981

Related U.S. Application Data

[63] Continuation-in-part of Ser. No. 214,222, Dec. 8, 1980, abandoned.

[30] Foreign Application Priority Data

Apr. 15, 1980 [JP] Japan ..... 55-48734

[51] Int. Cl.[3] ..... F42B 7/08

[52] U.S. Cl. ..... 102/453; 102/532; 244/323

[58] Field of Search ..... 102/448–463, 102/520–523, 532, 439; 244/3.23

[56] References Cited

U.S. PATENT DOCUMENTS 3,074,344 1/1963 Devaux ..... 102/460
3,247,795 4/1966 Abela .
3,398,682 8/1968 Abela ..... 102/439 X

FOREIGN PATENT DOCUMENTS 1454361 9/1966 France ..... 102/449
620234 5/1961 Italy ..... 102/450

*Primary Examiner*—Harold J. Tudor
*Attorney, Agent, or Firm*—Merchant, Gould, Smith, Edell, Welter & Schmidt

[57] ABSTRACT

A wad which is adapted to be located in a case of a shotgun cartridge containing gunpowder, comprising a cylindrical wad body having an axial center hole and axial explosive gas passages, and a disc plate which has a plunger fitted in the center hole of the wad body and which has blades connected thereto to carry a mass of pellets and to transmit a rotational motion of the wad to the pellets, said wad body and disc plate defining therebetween explosive gas passages extending in directions perpendicular to the axis of the cylindrical body, so as to rotate the wad about the axis of the cylindrical body by the explosive gas, which is produced by the explosion of the gunpowder when the wad body comes into contact with the disc plate under explosive pressure.

11 Claims, 23 Drawing Figures

Fig. 3
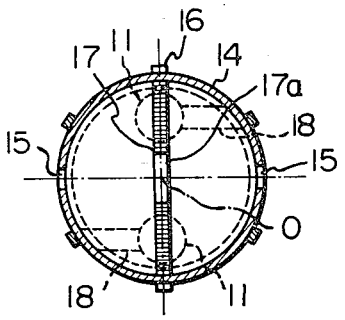
Fig. 15
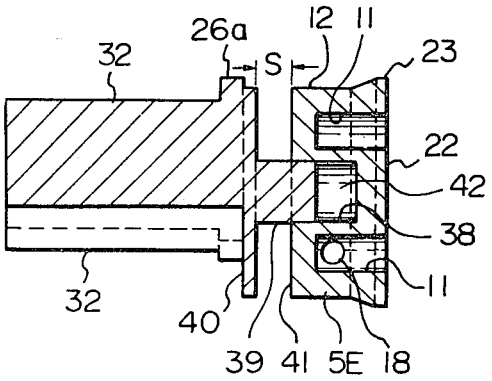
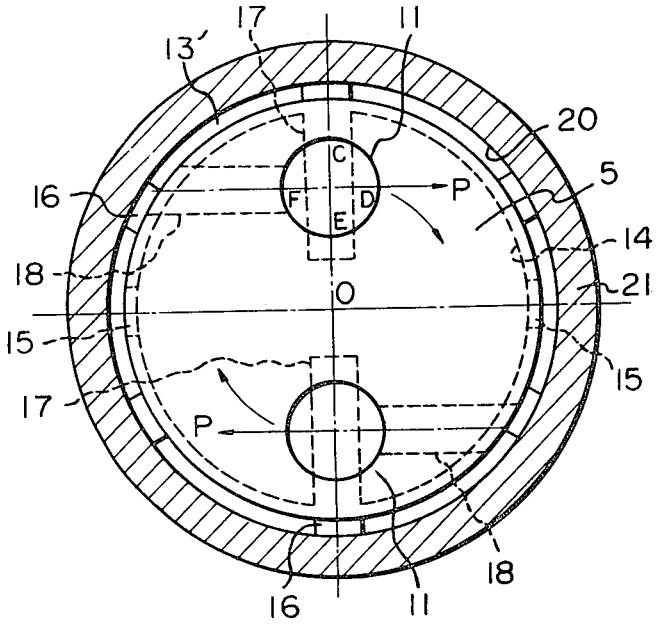
Fig. 4

SHOTGUN CARTRIDGE AND WAD THEREOF

This is a continuation-in-part application of a U.S. Patent application Ser. No. 214,222, filed on Dec. 8, 1980: abandoned This invention relates to a shotgun cartrige or ammunition for use with a choked barrel shotgun, and in particular to a shotgun cartridge which has a high hit probability even when it is adapted to shoot at a short distance with a shotgun for long distance shooting and which presents a higher hit probability at a near distance than that of a standard shotgun load when it is used with a short distance shooting shotgun. The invention is also directed to a wad located in a shotgun cartridge.

The shotgun is usually adapted to break up a target or to shoot game by causing a part of the spread shot to hit the target or the game which is moving. Therefore, no extremely accurate aiming is required to hit the target or game with a shotgun. Accordingly, one of the most important characteristics of a shotgun or shotgun load is how the fired shot is spread in accordance with the shooting range.

The degree of spread of a shot is usually represented by a "pattern" which will be referred to hereinafter and which is defined by the mark of pellets on a plane perpendicular to and located at the extension of a barrel axis. Furthermore, "an effective area of the pattern" used herein is defined by a circular area of the pattern density in which it is deemed that a clay target can be cracked or game can be hit with a certainty of 80% at a desired shooting range. A pellet designates herein a lead alloy ball which hits the target or game, and a shot herein designates a mass of pellets.

Some shotguns have barrels each of which is manufactured in such a manner that a portion adjacent to the top end of the muzzle thereof is choked to reduce the effective area of the pattern and to increase the pattern density so as to enable the shotguns to become fitted for long distance shooting. The barrel of such structure and the reduced portion will hereinafter be referred to as a "choked barrel" and a "choke," respectively. A (40"/1000) reduction at the diameter is called a "full choke", and no reduction barrel is called a "true cylinder." Further, ¾ choke, ½ choke, and ¾ choke are provided between the full choke and the true cylinder. In particular, a barrel having a slight reduction of approximately 3"/1000 is called an improved cylinder.

It should be noted that when two shots containing the same number of pellets are fired into a target at the same shooting range by shotguns which have different choked barrels, the pattern density and the effective area of the pattern of the shotgun having a largely choked barrel are higher and smaller than those of other shotgun which has a small choked barrel. Therefore, when short distance shooting is effected by a shotgun having a full choked barrel or ¾ choked barrel which is principally useful for long distance shooting, the shot tends to fail to hit the game. Further, even when the shot hits the game, excessive pellets are concentrated in the game, which causes extensive damage to the game, thereby reducing its value.

In order to solve this problem, there is proposed a double-barrelled shotgun which has differently choked barrels, or a single barrelled shotgun which has a variable or exchangeable choking device. A substitute barrel having a different choke can also be attached to the single barrelled shotgun when it is used for a different shooting distance.

However, in hunting, there are many cases where it is necessary to use a choked barrel shotgun in making a long distance shot by reasons of geography, the habits of game, the performance of the hunting dog, economy etc. In addition, in actual hunting, quick shooting is required, and even when a variable choking device is available, the hunter often does not have sufficient time to adjust a choke, to say nothing of having time to replace a choked barrel with a substitute barrel-such replacement in a short time is almost impossible. Further, in the case of a double barrelled shotgun having a combination of barrels of different chokes, the barrel with a higher degree of choke is not suitable for short distance shooting, and repeating two shots at a short distance is not desirable. Moreover, when a gamebird is shot with a single-barrelled repeater gun while the game is moving away, it is considered usual that the first shot is at a short distance, the second is at a medium distance and the third is at a long distance, but it has so far not been possible to repeat such shootings by use of chokes corresponding to the respective distances.

The object of the present invention is to eliminate the drawbacks mentioned above.

When a scatter load (cartridge) according to the present invention is shot from a full choked barrel, the load displays a wide pellet spreading range, equal to or superior to that obtained by a standard load shot from an improved cylinder barrel, and also displays a uniform and desirable pattern, and, accordingly, even a highly choked barrel shotgun could be used for performing ideal middle and short distance shootings by the selection of such a load. This applies to skeet shooting using a highly choked hunting gun.

The present invention has been developed to satisfy the above-mentioned ideal shooting and a preferred embodiment of the present invention will now be explained with reference to the accompanying drawings, in which FIG. 1 is a sectional view of a cartridge according to the present invention;

FIG. 3 is a front view of FIG. 2;

FIG. 4 is a sectional view of the wad taken along line IV—IV of FIG. 2;

FIG. 15 is a sectional view of a variant of FIG. 13;

Figure 1:
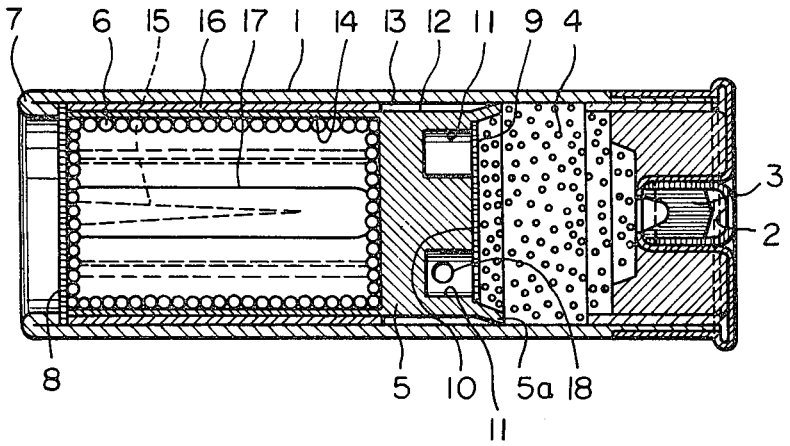

In FIG. 1, Numeral 1 indicates a case including a brass case head, Numeral 2 a primer, Numeral 3 an anvil, Numeral 4 gunpowder, Numeral 5 a wad (kollos in Dutch), and Numeral 6 group of pellets.

Figure 5:
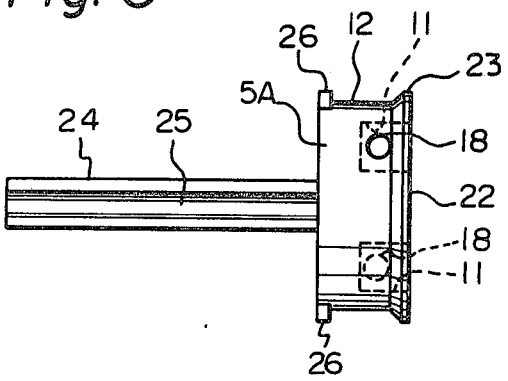
FIG. 5 is a side view of another embodiment of a wad of the cartridge according to the present invention.
Figure 6:
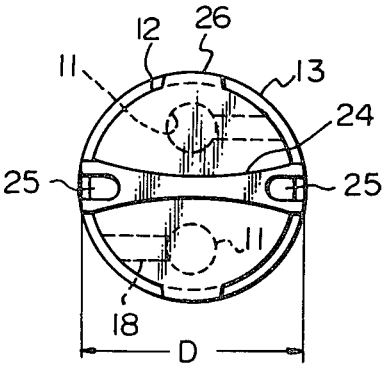
FIG. 6 is a front view of FIG. 5.

The wad 5 shown in FIGS. 1–4 is formed of a cylindrical body 5*b* of polyethylene or a like material and has a hollow conical end projection 5*a* having a concave portion 10 on its end facing the gunpowder 4. The conical end projection 5*a* acts as a seal which is in contact with the inner surface of the case 1 to prevent leakage of gases when the wad is located within the case 1 and which comes into contact with the inner surface 20 of the barrel 21 (FIG. 4) during the passage of the wad through the barrel. Alternatively, as shown in FIGS. 5 and 6, the conical end projection 5*a* (FIGS. 1–4) can be replaced by a conical end projection 23 which has a flat end surface 22.

Figure 7:
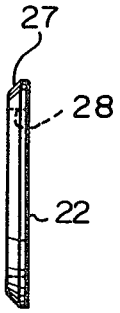
FIG. 7 is a side view of a ring as a gas sealing member.
Figure 8:
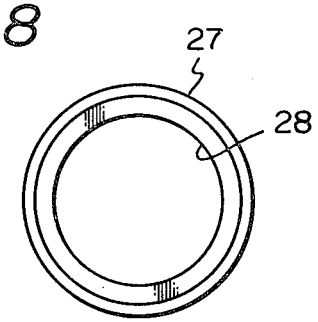
FIG. 8 is a front view of FIG. 7.
Figure 9:
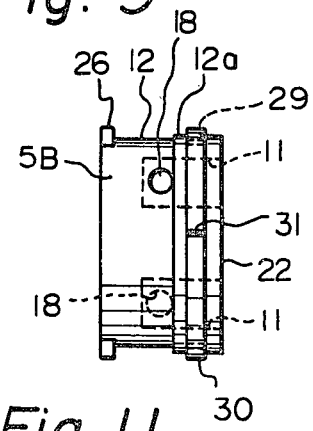
FIG. 9 is a side view of an essential portion of another embodiment of the gas sealing member.
Figure 10:
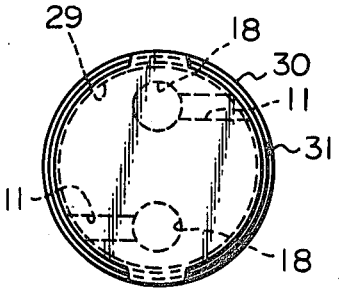
FIG. 10 is a front view of FIG. 9.

The diameter of the enlarged end of the projection 5*a* or 23 is substantially equal to the diameter of the barrel bore defined by the inner surface 20 (FIG. 4). Furthermore, it is also possible to prepare a separate piece of seal member which can be attached to the wad body, as shown in FIGS. 7 and 8. In FIGS. 7 and 8, a conical seal ring 27, as a seal member corresponding to the projection 5*a* or 23, has a hole 28 in which the wad 5 (FIGS. 1–4) or 5A (FIGS. 5 and 6) is fitted. For this purpose, the wad is provided, on its end facing the powder 4, with a circular projection (not shown) which has a diameter substantially corresponding to the inner diameter of the hole 28 of the ring 27 and which has a height substantially corresponding to the thickness of the ring 27. In this embodiment illustrated in FIGS. 7 and 8, the conical seal ring 27 also serves as a slide bearing of the wad. Alternatively, it is also possible to provide a wad 5B which has at its outer periphery 12*a* a peripheral groove 29 in which a resilient ring 30, with a ring gap 31 like a piston ring, is fitted, as shown in FIGS. 9 and 10. It should be noted here that the seal mechanism is not limited to the illustrated embodiments and may be of any construction which can ensure a seal effect against the explosion pressure of the gunpowder and which can decrease the friction which resists the rotational movement of the wad passing through the barrel.

A plurality of blind holes 11 are provided on the end of the wad that faces the gunpowder when the wad is located in the case 1 (FIG. 1). The blind holes 11 are equiangularly located on a circle around the center 0 (FIGS. 3, 4) of the wad.

In the illustrated embodiments (FIGS. 1–14), two blind holes 11 are diametrically arranged. The wad 5 (or 5A, 5B, 5C or 5D) rotates in a clockwise direction when viewed from the powder 4. A disc cover 9 (FIG. 1) is attached to the concave portion 10 (FIG. 1) or the end surface 22 (FIGS. 5, 9, 11, 13) to cover the blind holes 11. The disc cover 9 prevents the powder 4 from coming into the blind holes 11. The cover 9 can be easily broken under the explosive pressure. The cover 9 can be dispensed with when the powder 4, which is compacted by the pressure at the loading of the powder, is such that it does not get out of shape even without the cover. Each blind hole 11 has a restriction passage 18 connected thereto for applying a torque due to the thrust of the explosion to the wad 5. The explosion gas is partly ejected from the restriction passages 18 for providing the thrust P in the direction perpendicular to a line connecting the centers of the blind holes and the center 0 of the wad, as shown in FIG. 4. For this purpose, one end of each restriction passage 18 is connected to the corresponding blind hole 11 in the vicinity of the bottom of the blind hole and the other end of each restriction passage 18, which extends in a direction opposite to the direction of the thrust P, is connected to the peripheral side wall 12 of the wad body and opens into the outside thereof.

The diameter of the cylindrical periphery 12 of the wad is smaller than that of the sealing member, such as the annular projection 5*a* (FIG. 2) or 23 (FIG. 5, 13), or the rings 27 (FIG. 7) or 30 (FIG. 9), so that when the wad is in the case 1, a gas discharging gap 13 is provided between the inner periphery of the case 1 and the outer periphery 12, as shown in FIG. 1, and when the wad 5 passes through the barrel 21 (FIG. 4), a gap 13′ is also provided between the inner periphery 20 of the barrel, which has a diameter substantially equal to that of the inner periphery of the case 1, and the outer periphery 12. These gaps 13 and 13′ define a passage for the exhaust gas after the explosion of the powder 4 has occurred. These gaps can be replaced by an axial groove or grooves (not shown) formed on the outer periphery 12 of the wad.

On the side of the wad 5 (FIGS. 1, 2), that faces the pellets (shot) 6 when the powder 4, the wad 5 and the pellets 6 are located in the case 1, is provided a container 14 having a hollow cylinder which is integral with the wad body 5*b* and which has an axial length long enough to reach the paper disc cover 8 or it may be shorter than that.

Figure 2:
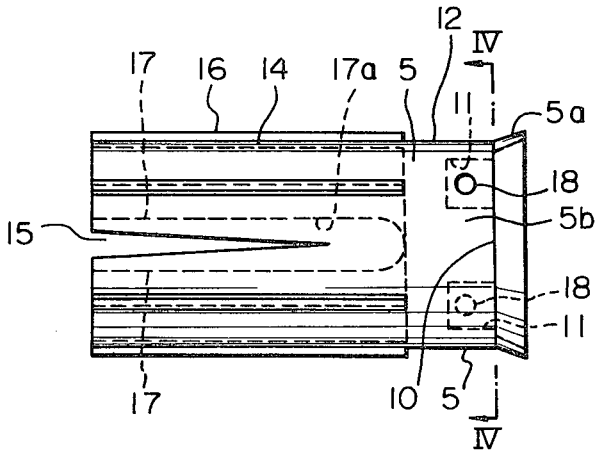
FIG. 2 is a side view of a wad of the cartridge according to the present invention.

Further, on the outer circumferential surface of the container 14 there are provided a plurality of projections or protrusions 16 extending in the direction of the axis thereof in symmetrical relationships with one another. The protrusions 16 define, between the container 14 and the inner periphery of the case 1, an exhaust gas passage (not shown) which is connected to the gap 13. The container 14 has a pair of V-shaped notches 15 (FIGS. 1 and 2). The inner wall surface of the container 14 is provided with a pair of partitions 17 in the diametral direction intersecting at right angles with the notches 15 at circumferential positions midway between the notches. The partitions 17 define an axial slit 17*a* therebetween. These partitions 17 serve as means for transmitting a rotary motion to the pellets 6.

The number and the shapes of the notches 15, slit 17*a*, the partitions 17 and the protrusions 16 can be modified, so that they can fully perform their functions. It is also possible to manufacture the partitions 17 separately from the container 14 and then the partitions 17 are attached to the container 14 so as to transmit the rotation of the wad 5 to the pellets 6.

A predetermined quantity of pellets 6 is packed into the container 14 and are blocked with the paper disc cover 8 fitted to the opening end of the container 14 which is locked by a crimp 7, or stopped by a so-called starcrimp formed by folding the top end of the case inwardly. The wad 5 which contains the pellets 6 is located and fixed in the case 1 to form a cartridge.

Three embodiments illustrated in FIGS. 5, 6; 11, 12; and 13, 14 do not include a member corresponding to the container 14. Instead of a container, a blade, or a plurality of blades serving as means for transmitting a rotary motion to the pellets 6, is provided on the side of the wad that faces the pellets 6, in these embodiments. The pellets 6 are packed around the blade(s). In the embodiment in FIGS. 5 and 6, a single blade 24 is included which has an axial length reaching the paper disc cover 8 of FIG. 1, or shorter than that when the gunpowder 4 and the wad 5A are loaded in the case 1. Both ends of the blade 24 are provided with thick walled portions in which grooves 25 are formed in the direction of the axis thereof to provide a passage for the exhaust gas. The grooves 25 are connected to the gap 13.

In this embodiment in FIGS. 5 and 6, there are provided a desired number of protrusions 26 on the circumferential surface 12 of the wad 5A, such that the diameter of a circle passing through the vertex of each of the protrusions 26 is substantially the same as the inner diameter of the case 1 and the inner wall surface 20 of the barrel 21 (FIG. 4). These protrusions 26 perform the same functions as those of the protrusions 16 formed on the outer circumferential surface of the container 14. Preferably, the blade 24 has a diameter D which is substantially identical to the inner diameter of the case 1 and the inner diameter of the barrel, so that the blade 24 can perform a role of protrusions the same as that of the protrusions 26.

The protrusions 26 also contribute to prevent the wad 5A, when it passes through the barrel 21, from being deflected with respect to the axis of the barrel. A part of the exhaust gas comes directly into spaces between the pellets 6 through the gap 13 and is discharged into the barrel through the spaces between the pellets 6.

Figure 11:
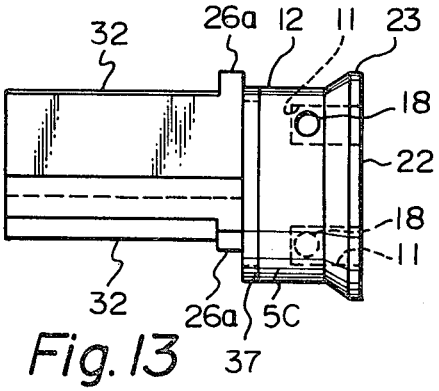
FIG. 11 is a side view of still another embodiment of a wad.
Figure 12:
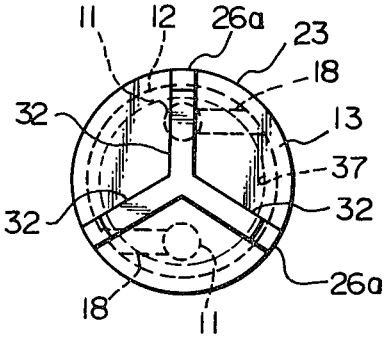
FIG. 12 is a front view of FIG. 11.

In an embodiment shown in FIGS. 11 and 12, on the side of the wad 5C that faces the pellets 6 are provided three blades 32 which are equiangularly arranged and which are provided, on their outer ends, with projections **26*a* for performing the same functions as those of the protrusions 16 or 26. Through the gap 13, which is small enough to prevent the pellets 6 from coming therein, the exhaust gas directly enters the spaces between the pellets 6, and, then, it is discharged into the barrel 21 (FIG. 4**).

Figure 13:
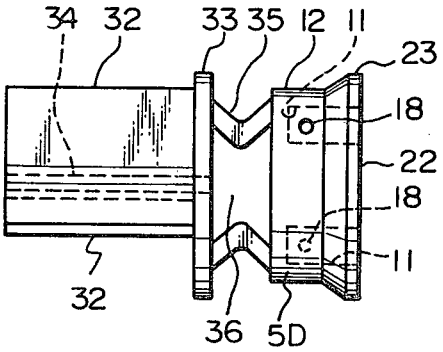
FIG. 13 is a side view of another embodiment of a wad.
Figure 14:
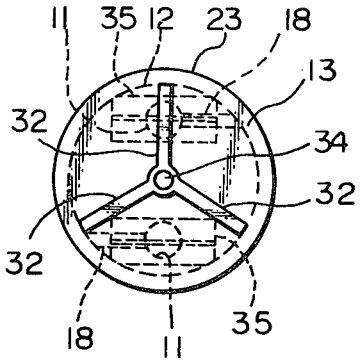
FIG. 14 is a front view of FIG. 13.

In an embodiment shown in FIGS. 13 and 14, there is provided a circular plate 33 which has a diameter substantially equal to that of the bore of the barrel 21 and which is provided with three equiagularly arranged blades 32. A passage 34 for the exhaust gas is formed in the center portion of the blades 32 at which the blades are interconnected. The plate 33 performs the same functions as those of the protrusions 16 (FIG. 3), 26 (FIG. 5) or **26*a* (FIG. 11) and also provides a seal effect for the exhaust gas. The plate 33 is rigidly connected to the wad 5D by means of cushions 35 which can be deformed when they are pushed by the wad 5D which is subjected to the explosive pressure to absorb the explosive pressure of the powder 4 which rapidly increases at the initial stage of explosion. The outer diameter of the cushions 35 is smaller than that of the periphery 12 of the wad 5D. The cushions 35 are, for example, diametrically opposed to each other, so that a space 36 is provided which is always connected to the gap 13 even when the cushions are deformed. The space 36 is also connected to the passage 34, so that the exhaust gas from the gap 13 flows through the space 36 and the passage 34, and is then discharged into the barrel bore. The cushions 35 can be dispensed with and, in this case, the blades 32 are directly connected to the wad 5D. Further, in this case, an exhaust gas passage (not shown) must be formed in the wad body to connect the outer periphery 12 of the wad 5D and the passage 34. Further, all or some of the wad (body) 5D, the cushions 35, the plate 33, and the blades 32** can be formed as separate elements which can be assembled later.

The cushions 35 can be replaced by a bellows tube which contains therein a compressible fluid (e.g. air).

FIG. 15 shows a variant of a wad illustrated in FIG. 13.

In FIG. 15, which is a sectional view taken along a plane including the center of the blades 32 and the center axis of the wad 5E, shows the wad (body) 5E connected to the blades 32 by means of a plunger 39 which is in turn rigidly connected to a disc plate 40 integral with the blades 32. The wad body is provided, on its end face 41 opposing the disc plate 40, with a blind hole 38 in which the plunger 39 is press fitted, so that the rotation of the wad body can be transmitted to the blades 32 by the friction between the plunger 39 and the inner periphery of the blind hole 38. The blind hole 38 extends coaxially to the center axis of the wad body. The disc plate has a diameter substantially equal to that of the outer periphery 12 of the wad body 5E. Between the disc plate 40 and the end face 41 of the wad body is provided a predetermined gas S, which enables the wad body to move toward the blades 32. When the plunger 39 is press fitted in the blind hole 38, an enclosed space 42 is provided in the blind hole 38 by the plunger 39. When the explosion of the gunpowder takes place, the wad body first moves toward the blades 32 while compressing the air in the enclosed space 42 until the wad body comes in contact with the disc plate 40. The blades 32, on which the pellets 6 (FIG. 1) are packed, do not move forward until the wad body comes into collision with the disc plate 40, since the blades 32 bear against the paper disc cover 8 which is held by the crimp 7 (FIG. 1). After the wad body collides with the disc plate 40, the wad body and the blades are ejected from the case 1 while maintaining their relative angular position, in the same fashion as in FIGS. 11 and 12. As can be seen from the above discussion, the combination of the plunger 39 and the blind hole 38, in which the plunger 39 is press fitted, provides a cushion mechanism the same as the cushions 35 in FIGS. 13 and 14. It should be noted here that, instead of the press fit of the plunger 39 into the blind hole 38, a spline mechanism or a serrated mechanism can be provided between the plunger 39 and the blind hole 38, so that the wad body can move axially on the plunger 39, but cannot rotate relative to the latter. Alternately, it is also possible to provide a plunger and a blind hole which have complementary polygonal sectional shapes or which have complementary convex and concave shapes.

In the three embodiments mentioned above, which include no container, the pellets 6 are directly located around the blade 24 or blades 32. Apart from this location of the pellets 6, the constructions of the paper disc cover 8 and the crimp 7 are the same as those in the embodiment including the container 14. The shape and the number of the blades are not limited to the above mentioned embodiments. For example, the blades 32 may be of a spiral shape.

Furthermore, in the wad 5 shown in FIGS. 2 and 3, the projections 16 and the partitions 17 can be dispensed with. In this case, the end of the wad that faces the pellets 6 are provided with a required number of protrusions 26, as shown in FIGS. 5 and 9, and the notches 15 extend to the bottom of the container 14. Also in this case, blades 32 can be provided in the container 14. In this modification, the exhaust gas passes through the gap 13 and the space between the protrusions 26. Then, a part of the exhaust gas passes through the small gap between the container 14 and the barrel bore and the remaining exhaust gas enters the pellets 6 through the notches 15 and can be discharged into the barrel bore, similar to the embodiment shown in FIGS. 11 and 12.

When small size pellets 6 are used, they may break the front edge of the peripheral side wall 12 so that they enter the gap 13. In order to solve this problem, a ring 37 which is made of a material, such as steel, harder than the pellets 6, can be provided on the front end of the periphery 12, as shown in FIGS. 11 and 12. The ring 37 can prevent the pellets 6 from coming into the gap 13.

It is also possible to provide a container 14 which includes neither the protrusions 16 nor the partitions 17 and which has a diameter substantially equal to that of the barrel bore. In this case, the blades 32 having the passage 34 (FIGS. 13 and 14) connected to the gap 13 can be provided in the container 14. The exhaust gas can be discharged from the passage 34.

Furthermore, it should be noted that various kinds of modifications or variants mentioned above can be optionally combined.

The operation of the cartridge of the present invention having the above structure will now be explained. When a firing pin (not shown) strikes the primer 2 having an anvil 3, the gunpowder 4 is ignited to generate an explosive gas and when the pressure of the gas reaches a value of about 70 lbs/in$^2$ the disc cover 9 is broken. The wad 5 begins to move forward and at the same time the top end of the container 14, which is integral with the wad 5 and which stores the pellets 6 therein, pushes out the paper disc cover 8 to release the crimp 7 of the case 1. Thus, a portion of the explosion gas pressure enters the blind holes 11 and then reaches the rear surface of the cover 8 from the gap 13 via the passage 18. However, since the cover 8 has already been scattered into the barrel bore at this time, the explosive gas jetted out from the blind holes 11 is discharged out into the atmosphere, together with the cover 8.

When the explosion gas pressure is released, a torque generates on the wad 5, due to the principle of jet propulsion, and, in the case of the embodiment of FIGS. 1 through 3, the wad 5, including the container 14 integral therewith, begins to rotate and passes through the inner wall surface 20 of the barrel 21 during which the speed of rotation of the wad increases rapidly. The factors for generating the torque on the wad by discharging a part of the explosion gas pressure may be explained as follows: When, in FIG. 4, the pressure receiving area of the side portion of the inner wall of each of the blind holes 11, as indicated by letters CDE is compared to that indicated by letters EFC, it will be seen that the former is larger than the latter by the effective sectional area of each of the restriction passages 18, because each restriction passage opens toward that EFC side, and comes into contact with the atmosphere through the gaps formed by the protrusions 16 on the outer circumferential surface of the container 14 when the wad 5 passes through the inner wall surface of the barrel. Accordingly, a pressure difference takes place between the pressure receiving areas of both of the above-mentioned sides, due to the differences in width between their pressure receiving areas, and a force P, acting in the direction of the arrows in FIG. 4, generates whereby a torque about the central point 0 of the wad is obtained.

Thus, the passage of the rotating wad 5 through the inner wall surface 20 of the barrel causes the rotation of the container 14 integral with the wad 5. Accordingly, the pellets 6 stored in the container 14 make circular motions about the center axis of the container 14, together with the rotation of the wad 5 in the state of their being separately put into two sections by the partitions 17. When the wad 5 goes out from the muzzle, the container 14 is split into two parts through the notches 15 and the flying speed of the wad decreases rapidly due to the wind pressure exerted on it area which is wider than before. Therefore, the group of pellets stored in the container fly forward leaving the wad 5 behind and, in this case, each of the pellets 6 flies at a combined speed of the tangential speed of its circular motion just prior to its leaving the container 14 and its speed in the direction of the shot traveling. Thus, the pellets can be positively spread, even when they are shot from a choked barrel.

Further, it should be noted that the individual pellets fly in directions slightly different from one another, because of the fact the tangential speed of the pellets located outside is different from that of those located inside and, therefore, the pellets as a group spread uniformly without forming a doughnut-like pattern. Further, assuming that two kind of shots have the same muzzle velocities and the same continuing velocities which the shots maintain at the time when the shots have travelled a certain distance, the rate of spreading of the pellets or shot being determined by the speed of rotation of the wad leaving the muzzle so that the required rate of spreading can be obtained by the proper selection of the diameter of each of the restriction passages 18, the burning characteristic and the quantity of the loaded gunpowder 4 thereby adjusts the resultant torque on the wad. The above discussion is applicable to the embodiments which do not have the container 14.

In addition, in the case of using the blade 24 shown in FIGS. 5 and 6, rotating power is transmitted to the pellets 6 through the blade 24, so that the pellets reach the muzzle after passing through the barrel while keeping their mass state, since the pellets 6 are forced by the wad 5A which continues the rapid acceleration motion by the explosion after having left the case 1. In this case, since each pellet rotates about the axis of the barrel, the pellets fly while radially spreading after having left the muzzle, like the pellets which are shot from the wad having the container 14, as mentioned above.

Although the embodiment illustrated in FIGS. 11 and 12 is different from the embodiment shown in FIGS. 5 and 6 in that three blades 32 are provided and the passage for the exhaust gas is defined by the spaces between the pellets 6 in FIGS. 11 and 12, the pellets are forced to be spread out by their rotational movement, similarly to the embodiment in FIGS. 4 and 5. It has been experimentally found that no pellets are melted by the exhaust gas or become struck to each other. This is because the high temperature exhaust gas is expanded after ejection, resulting in a decrease of the temperature and because the pellets 6 are in contact with the exhaust gas for an extremely short period of time.

The embodiment shown in FIGS. 13 and 14 operates substantially the same as the embodiment shown in FIGS. 11 and 12, except for the route of the exhaust gas and for the pressure of the cushions 35.

In the three embodiments which include no container, since the wad, which is formed by a material having a density below 1, is light and since the area which is subject to the wind pressure is large, the ejected wad rapidly decelerates and is separated from the pellets 6 so that the wad has no undesirable influence on the pattern.

Finally, FIGS. 16–22 show a modifications of FIG. 15, wherein a wad (wad body) 5F has a plurality of axially parallel holes 52 located on an imaginary circle. The number of holes 52 can be determined in accordance with the amount of the discharged explosive gas. The end of each hole 52 that is located adjacent to the powder 4 (FIG. 1) is covered or closed by a thin film layer 44 which may be integral with the wad body and which is equivalent to the disc cover 9 in FIG. 1. The other end of each hole 52 opens at the end face 51 of the wad body. The wad body 5F has a center axial through hole 43 in which a front end of a plunger 39*a* is inserted.

Figure 16:
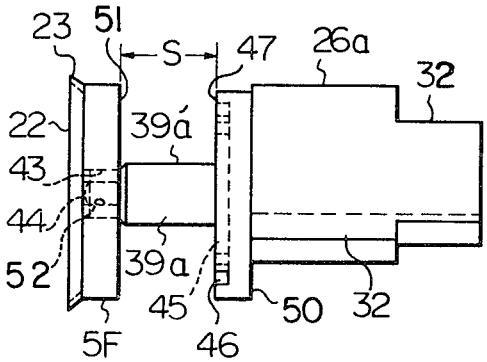
FIG. 16 is a sectional view of a modification of FIG. 15.
Figure 17:
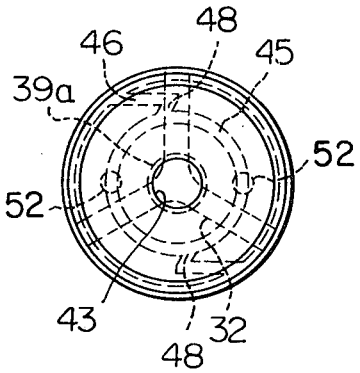
FIG. 17 is a right side elevational view of FIG. 16.
Figure 18:
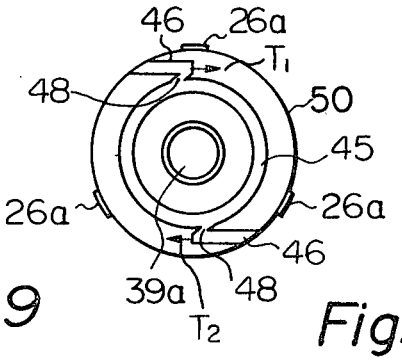
FIG. 18 is an end view of a disc plate, shown in FIG. 16, with blades and a plunger.
Figure 19:
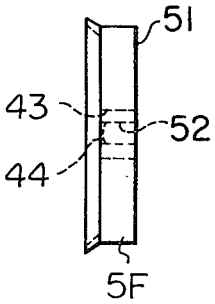
FIG. 19 is a side view of a wad body shown in FIG. 16.
Figure 20:
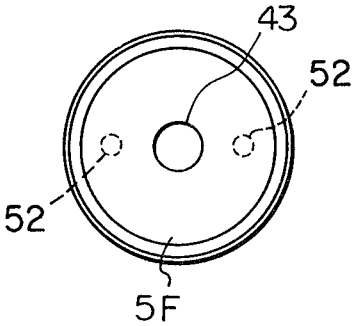
FIG. 20 is an end view of FIG. 19.
Figure 21:
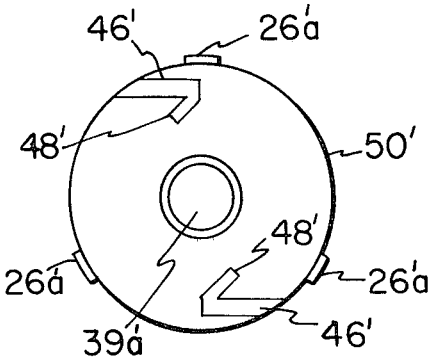
FIG. 21 is an end view, similar to FIG. 18, of a modified disk plate.
Figure 22:
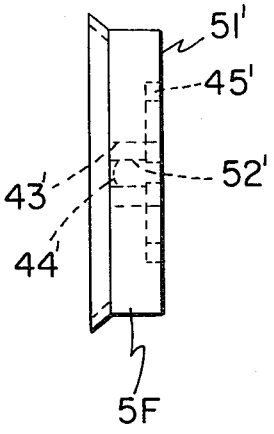
FIG. 22 is a side view of the modified wad body.
Figure 23:
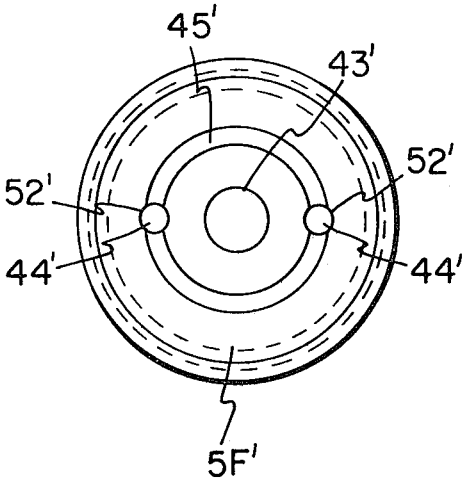
FIG. 23 is an end view of the modified wad body of FIG. 22.

On the other hand, the disc plate 50 shown in FIGS. 16–18 has an end face 47 provided thereon with an annular groove 45 which is concentrical to the through hole 43 and which has a diameter substantially equal to that of the imaginary circle defined by the holes 52 of the wad body 5F. On the end face 47 are also provided jet grooves 46 which are connected to the annular groove 45 by means of connecting grooves 48 connected to the jet grooves 46 preferably at an acute angle and which open in predetermined directions. The front end of the plunger 39*a* that is inserted in the through hole 43 of the wad body 5F has a diameter substantially equal to that of the hole 43. Preferably, the plunger 39*a* has a larger diameter portion 39*a*′, which diameter is slightly larger than that of the front end of the plunger 39*a*, so that when the larger diameter portion 39*a*′ is forced in the through hole 43 by the explosion pressure, a large press-in resistance is provided. The annular groove 45 can be provided on the end face 51 of the wad body 5F, instead of on the end face 47 of the disc plate 40. Furthermore, the annular groove 45 and the connecting grooves 48 can be dispensed with, when no relative rotation occurs between the wad body 5F and the plunger 39*a*, for example, by the provision of the wad body and the plunger which are both of a polygon shape and when the holes 52*a* of the wad body are located in alignment with the ends of the corresponding connecting grooves 48 adjacent to the jet grooves 46 of the disc plate 40. See FIGS. 21–23 which are similar to FIGS. 18–20 except the numbers for corresponding elements are primed.

The embodiments illustrated in FIGS. 16–22, operate similarly to the embodiment in FIG. 15, except for the following particular operations.

1. When the explosive pressure reaches about 70 lbs/in$^2$ after explosion of the powder, the film layers 44 are broken, which correspond to the disc cover 9 in FIG. 1, and then the explosive gas begins to enter the holes 52.

2. The wad body 5F moves by the distance S under explosive pressure, so that it is brought into close contact with the end face 47 of the disc plate 50. By the close contact between the end faces 51 and 47 of the wad body 5F and the disc plate 50, respectively, the jet grooves 46 provide discharge gas passages corresponding to the restriction passages 18 in FIG. 15. Thus, the explosive gas which enters the holes 52, which correspond to the blind holes 11 in FIG. 15, passes the annular groove 45 and the connecting grooves 48, and is discharged from the jet grooves 46.

When the gas enters the jet grooves 46 from the connecting grooves 48, the direction of the gas flow varies at an acute angle, so that the thrusts $T_1$ and $T_2$ (FIG. 18) are produced as a result of the reaction of the jet gas. Thus, the disc plate 50 and the blades 32 integral with the disc plate 50 can be rotated.

The annular groove 45 ensures that, when the wad body 5F comes into contact with the disc plate 50, the holes 52 are always located on the annular groove 45, independently of the angular location of the wad body about the plunger 39*a*.

3. When the wad body 5F moves toward the disc plate 50, the larger diameter portion 39*a*′ of the plunger 39*a* provides a cushion corresponding to the enclosed space 52 in FIG. 15, since the larger diameter portion 39*a*′ of the plunger 39*a* has a diameter slightly larger than that of the through hole 43 of the wad body 5F, so that the larger diameter portion 39*a*′ is a resistance against the axial movement of the wad body 5F.

Since no disc cover 9 is necessary in the embodiment illustrated in FIGS. 16–22, the manufacturing cost and steps can be accordingly decreased. Furthermore, since the laterally extending restriction passages 18 in FIG. 15 is provided neither on the wad body nor on the disc plate in FIGS. 16–22, the wad body is simpler in construction and, accordingly, the design of dies for molding the wad body become simple.

As described above, the scatter load type of cartridge according to the present invention is constructed so that a group of pellets are packed into a container which is formed integral with a wad and which has partitions formed therein, the wad is caused to pass through a barrel by a gas pressure generation due to the explosion of gunpowder during which a torque is generated by the action of jet propulsion to cause the group of pellets to take circular motions, whereby when the container goes out from the muzzle of the barrel, it is split into two parts, or in the case of a wad having no such container, the group of pellets are forced to fly separately from the wad as the flying speed of the latter is reduced. Thus, the cartridge according to the present invention has an advantage in that it can be used with a long distance choked barrel shotgun, even in making a short distance shot, with a wide pellet spreading range equal to that obtained in the case of a short distance shotgun and with a uniformly distributed desirable pattern and ideal short and medium distance shooting can be performed with a long distance choked barrel shotgun by the selection of such cartridge.

Finally, the wad according to the present invention can be adapted to be reloaded in a shotgun cartridge.

I claim:

1. A wad for use in a case of a shotgun cartridge containing gunpowder, said wad comprising a cylindrical body having an axial center hole and first explosive gas passages extending through said body in directions parallel to the axis, said wad comprising further a disc plate which has a plunger fitted in and connected to the center hole of the wad body and which has at least one blade connected thereto to carry a mass of pellets and to transmit a rotational motion of the wad to the pellets, said body and said disc plate being separated by a predetermined gap, said wad body and said disc plate when forced together defining therebetween second explosive gas passages extending in directions non-radial to the axis of the cylindrical body, said body and said disc plate having a side surface spaced from the axis, said body having a bottom surface, said wad also comprising means for spacing a portion of said side surface from said case, said spacing means including means for preventing passage of explosive gases passed the bottom of said body other than through said first explosive gas passages, a portion of said second explosive gas passages being aligned with said first explosive gas passages, said second explosive gas passages extending to the side surface of one of said body and said disc plate, whereby the explosive pressure of said exploding gunpowder causes said body and said disc plate to come together thereby causing the explosive gases flowing through said first and second explosive gas passages to rotate said wad about said axis.

2. A wad according to claim 1, wherein covers close one end of the first explosive gas passages of the wad body, which covers can be broken when the explosive pressure is a predetermined value.

3. A wad according to claim 1, wherein said plunger has a larger diameter portion which is slightly larger than that of the axial center hole of the wad body, to provide resistance against the axial movement of the wad body.

4. A wad according to claim 1, wherein said wad body has a top surface with an annular groove therein concentrical to the center hole and which is in fluid communication with said first explosive gas passages of the wad body.

5. A wad according to claim 4, wherein said disc plate has a bottom surface with said second explosive gas passages located therein whereby said first and second explosive gas passages and said annular groove are in fluid communication to rotate said wad when the wad body comes into close contact with the disc plate under explosive pressure.

6. A wad according to claim 1, wherein said disc plate has a bottom surface wherein said second explosive gas passages include an annular groove and jet grooves which are connected to the annular groove, said annular groove being aligned with said first explosive gas passages, said jet grooves extending in such directions that the explosive gas discharged from the jet grooves causes the wad to rotate.

7. A wad according to claim 6, wherein said first explosive gas passages of the wad body are located on an imaginary circle corresponding to the annular groove of the disc plate.

8. A wad according to claim 6 wherein said jet grooves are spaced apart from said annular groove, said second explosive gas passages further including connecting grooves provided on the disc plate for connecting the annular groove and the jet grooves.

9. A wad according to claim 1 wherein said disc plate includes a bottom surface, said second explosive gas passages being located in said bottom surface, said first and second explosive gas passages being in fluid communication when said body and said disc plate come together under explosive pressure.

10. A wad according to claim 5 wherein said second explosive gas passages include jet grooves and connecting grooves, said jet grooves being spaced apart from and nearly tangent to an imaginary circle of diameter the same as the larger diameter of said annular groove in said body, said connecting grooves connecting said jet grooves with the imaginary circle.

11. A shotgun cartridge comprising a case, a wad located in the case, and gunpowder located adjacent to the wad in the case, said wad comprising a cylindrical body having an axial center hole and first explosive gas passages extending through said body in directions parallel to the axis, said wad comprising further a disc plate which has a plunger fitted in and connected to the center hole of the wad body and which has blades connected thereto to carry a mass of pellets and to transmit a rotational motion of the wad to the pellets, said body and said disc plate being separated by a predetermined gap, said wad body and said disc plate defining therebetween second explosive gas passages extending in directions non-radial to the axis of the cylindrical body, said body and said disc plate having a side surface spaced from the axis, said body having a bottom surface, said wad also comprising means for spacing a portion of said side surface from said case, said spacing means including means for preventing passage of explosive gases passed the bottom of said body other than through said first explosive gas passages, a portion of said second explosive gas passages being aligned with said first explosive gas passages, said second explosive gas passages extending to the side surface of one of said body and said disc plate, whereby the explosive pressure of said exploding gunpowder causes said body and said disc plate to come together thereby causing the explosive gases flowing through said first and second explosive gas passages to rotate said wad about said axis.

* * * * *

UNITED STATES PATENT AND TRADEMARK OFFICE

CERTIFICATE OF CORRECTION

PATENT NO. : 4,452,144

DATED : June 5, 1984

INVENTOR(S) : Nagatoshi Maki

It is certified that error appears in the above-identified patent and that said Letters Patent are hereby corrected as shown below:

Column 1, line 6, "1980." should be --1980,--.

Column 1, line 7, "cartrige" should be --cartridge--.

Column 8, line 15, delete "it" and insert therefor --its--.

Column 8, line 62, delete "struck" and insert --stuck--.

Column 9, line 10, delete "a", following "show".

Column 10, line 23, delete "embodiment" and insert therefor --embodiments--.

Column 11, line 6, delete "passed" and insert therefor --past--.

Signed and Sealed this

*Fifteenth* Day of *January 1985*

[SEAL]

*Attest:*

GERALD J. MOSSINGHOFF

*Attesting Officer*

*Commissioner of Patents and Trademarks*